US005091674A

United States Patent [19]

Zimlich et al.

[11] Patent Number: 5,091,674

[45] Date of Patent: Feb. 25, 1992

[54] GAS DISCHARGE LAMP WITH GLASS TUBE AND SEAL MEMBERS

[75] Inventors: Josef Zimlich; Ingo Duenisch, both of Taunusstein; Eugen Achter, Trebur, all of Fed. Rep. of Germany

[73] Assignee: Siemens Aktiengesellschaft, Munich, Fed. Rep. of Germany

[21] Appl. No.: 729,990

[22] Filed: Jul. 15, 1991

Related U.S. Application Data

[63] Continuation of Ser. No. 527,430, May 23, 1990, abandoned.

[30] Foreign Application Priority Data

Jun. 6, 1989 [EP] European Pat. Off. ..... 89110243.6

[51] Int. Cl.[5] ..... H01J 61/30; H01J 61/36

[52] U.S. Cl. ..... 313/625; 313/634

[58] Field of Search ..... 313/623, 624, 625, 634

[56] References Cited

U.S. PATENT DOCUMENTS

| | | | |
|---|---|---|---|
| 3,886,392 | 5/1975 | Barakitis et al. . | |
| 3,986,236 | 10/1976 | Barakitis et al. . | |
| 4,147,952 | 4/1979 | Webb et al. . | |
| 4,198,586 | 4/1980 | de Jong et al. . | |
| 4,203,050 | 5/1980 | Rech et al. . | |
| 4,691,141 | 9/1987 | Buhrer et al. | 313/625 X |
| 4,803,403 | 2/1989 | Makar, Jr. et al. | 313/625 X |

FOREIGN PATENT DOCUMENTS

| | | | |
|---|---|---|---|
| 0136564A2 | 4/1985 | European Pat. Off. . | |
| 142202 | 5/1985 | European Pat. Off. | 313/625 |
| 0204303A2 | 12/1986 | European Pat. Off. . | |
| 2001425 | 7/1970 | Fed. Rep. of Germany . | |
| 3227280A1 | 1/1984 | Fed. Rep. of Germany . | |
| 2387512 | 11/1978 | France . | |
| 63871 | 4/1985 | Japan | 313/623 |

*Primary Examiner*—Palmer C. DeMeo

*Attorney, Agent, or Firm*—Hill, Van Santen, Steadman & Simpson

[57] ABSTRACT

A gas discharge lamp having an accurate centering of electrodes. The gas discharge lamp has a gas-filled glass tube whereby the electrodes are inserted at end faces of the glass tube. Each electrode is melted into respectively a hollow-cylinder-type glass member residing inside an end of the glass tube. The outside end face of each glass member lies approximately flush with the corresponding end face of the glass tube and is coated, together with the end face of the glass tube, with a layer of glass solder.

2 Claims, 1 Drawing Sheet

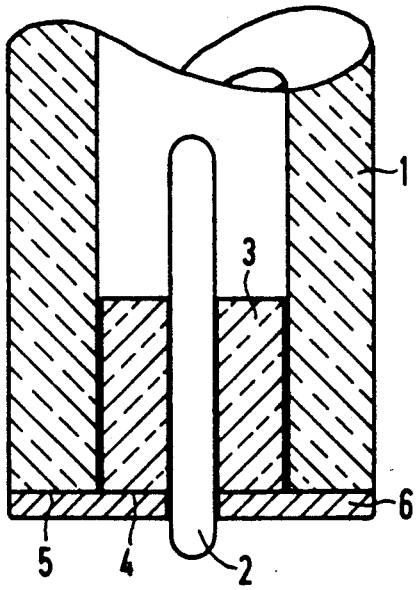
1
3
6
5
4
2

GAS DISCHARGE LAMP WITH GLASS TUBE AND SEAL MEMBERS

This is a continuation of application Ser. No. 527,430, filed May 23, 1990 and now abandoned.

BACKGROUND OF THE INVENTION

The present invention relates to a gas discharge lamp with a gas-filled glass tube having two electrodes which project from end faces thereof.

It is known to design a gas discharge lamp of this type at both of its ends in the manner that a respective pin-shaped electrode is melted in a glass member which is located on the end face of the glass tube with an intermediate layer of glass solder. The composition of the glass solder is thereby adapted to the hard glass of the glass tube in its thermal expansion so that no thermal stress results. The centering of the electrodes in the glass tube is, however, unsatisfactory. An accurate centering is desireable, so that no uneven blackening of the inside of the glass tube due to electrode consumption occurs.

SUMMARY OF THE INVENTION

It is an object of the present invention to provide a gas discharge lamp of the initially cited type such that an accurate centering of the electrodes occurs with only a small process tolerance.

According to the present invention this problem is solved in that the electrodes are melted respectively into one hollow-cylinder-type glass member inserted in matching fashion into the glass tube, whereby the outer end face of each glass member is approximately flush with the corresponding end face of the glass tube, and, together with this end face, coated with a layer of glass solder. The present invention provides that the centering of the electrodes results from the glass member residing inside the glass tube and fitting therein. A gas-tight seal of the gas discharge lamp is guaranteed due to the layers of glass solder provided at the end faces, which respectively covers the end face of the glass tube and the glass member carrying the electrode.

BRIEF DESCRIPTION OF THE DRAWING

The features of the present invention which are believed to be novel, are set forth with particularity in the appended claims. The invention, together with further objects and advantages, may best be understood by reference to the following description taken in conjunction with the accompanying drawing, and in which:

The single figure is a partial cross-sectional view of the gas discharge lamp of the present invention.

DESCRIPTION OF THE PREFERRED EMBODIMENT

The single figure shows a gas discharge lamp with a gas-filled glass tube 1 into which two electrodes project from corresponding end faces. In the single figure, only one end of the glass tube with the corresponding electrode 2 is shown. The other end is substantially identically fashioned.

The electrode 2 is melted into a hollow-cylinder-type glass member 3 which is matchingly inserted inside the glass tube 1. The outside end face 4 of the glass member 3 is approximately flush with the end face 5 of the glass tube 1. Both end faces 4, 5 are covered by a layer 6 of glass solder which seals the inside space of the glass tube 1. The electrode extends through the glass member 3 and the layer 6 and projects outward so that an electrical connection is possible.

The glass member 3 provides an accurate centering of the pin-shaped electrode 2, whereby an uneven blackening of the inside of the glass tube 1 due to electrode consumption is prevented.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A gas discharge lamp comprising a gas-filled glass tube into which two electrodes project from respective end faces thereof, each electrode being melted into a hollow-cylinder-type glass member which is matchingly inserted inside the glass tube such that each hollow-cylinder-type glass member provides an accurate centering of the respective electrode in the glass tube, an outside end face of each glass member being approximately flush with a corresponding end face of the glass tube and only the outside end face of the glass member and only the end face of the glass tube being substantially covered by a layer of glass solder.

2. A gas discharge lamp comprising:

a gas-filled glass tube having at least first and second ends with corresponding end faces;

at least first and second glass members containing substantially axially located first and second electrodes, respectively, said electrodes extending substantially through said glass members, each of said glass members having an outer end face;

each of said glass members having an outer configuration which substantially matches an inner configuration of the respective end of the gas-filled glass tube in which the glass member is located, each glass member being located in its respective end of the glass tube such that the outer end face of the glass member is substantially flush with the end face of the end of the gas-filled glass tube and such that the respective electrode is accurately centered in the glass tube; and first and second layers of glass older substantially covering only the outer end faces of the first and second glass members and only the first and second ends of the glass tube, respectively.

* * * * *